US011497951B2

(12) United States Patent
Wilson

(10) Patent No.: US 11,497,951 B2
(45) Date of Patent: Nov. 15, 2022

(54) INSPECTION SYSTEM AND METHOD FOR HVAC UNITS

(71) Applicant: John Wilson, Westfield, MA (US)

(72) Inventor: John Wilson, Westfield, MA (US)

(73) Assignee: Mestek, Inc., Westfield, MA (US)

( * ) Notice: Subject to any disclaimer, the term of this patent is extended or adjusted under 35 U.S.C. 154(b) by 92 days.

(21) Appl. No.: 15/343,298

(22) Filed: Nov. 4, 2016

(65) Prior Publication Data

US 2017/0128760 A1 May 11, 2017

Related U.S. Application Data

(60) Provisional application No. 62/251,861, filed on Nov. 6, 2015.

(51) Int. Cl.

| | |
|---|---|
| ***A62C 37/50*** | (2006.01) |
| ***F24F 13/14*** | (2006.01) |
| *A62C 2/24* | (2006.01) |
| *F24F 140/40* | (2018.01) |
| *A62C 2/14* | (2006.01) |

(52) U.S. Cl.
CPC ..... *A62C 37/50* (2013.01); *F24F 13/14* (2013.01); *A62C 2/14* (2013.01); *A62C 2/24* (2013.01); *F24F 2140/40* (2018.01)

(58) Field of Classification Search
CPC ..... F24F 11/33; F24F 11/35; F24F 2140/40; A62C 37/50; A62C 2/12; A62C 2/14; A62C 2/16; F16K 37/0058; F16K 37/0083
See application file for complete search history.

(56) References Cited

U.S. PATENT DOCUMENTS 5,195,392 A * 3/1993 Moore ..... F16L 55/18 138/97
2004/0224627 A1* 11/2004 Becelaere ..... F24F 11/0001 454/257
2006/0091310 A1* 5/2006 Furry ..... G01N 21/3518 250/330
2007/0247335 A1* 10/2007 Schiek ..... B64D 13/04 340/945

(Continued)

FOREIGN PATENT DOCUMENTS

AU 2013224709 A1 * 3/2014
CN 204575135 U * 8/2015
WO WO2015074763 * 5/2015

OTHER PUBLICATIONS

AMCA, What Engineers Need to Know About Fire & Smoke Dampers, Jan. 2015 (Year: 2015).*

(Continued)

*Primary Examiner* — Eric S Ruppert
(74) *Attorney, Agent, or Firm* — Grogan, Tuccillo & Vanderleeden, LLP

(57) ABSTRACT

An inspection system for an HVAC device includes an HVAC duct section, a damper positioned with the duct section, an actuator for selectively moving the damper to a closed position, and a verification camera for recording the position of the damper with a date stamp and a time stamp. The actuator is further configured to move the damper to its open position, and the verification camera is further configured to record the open position of the damper with a second date and time stamp.

8 Claims, 1 Drawing Sheet

(56) References Cited

U.S. PATENT DOCUMENTS

| | | | | |
|---|---|---|---|---|
| 2013/0155227 | A1* | 6/2013 | Ferik | G01B 11/00 348/143 |
| 2013/0223494 | A1* | 8/2013 | Jensen | G01M 3/184 375/224 |

OTHER PUBLICATIONS

CarolinaFilters, 7 Must Knows for Fire Damper Inspections, Aug. 2015 (Year: 2015).*
"Timestamp," A Dictionary of Computing, Oxford University Press (Year: 2008).*

* cited by examiner

INSPECTION SYSTEM AND METHOD FOR HVAC UNITS

CROSS-REFERENCE TO RELATED APPLICATIONS

This application claims the benefit of U.S. Provisional Application Ser. No. 62/251,861, filed on Nov. 6, 2015, wherein is hereby incorporated by reference herein in its entirety.

FIELD OF THE INVENTION

The present invention relates generally to HVAC systems and, more particularly, to an inspection system and method for HVAC units.

BACKGROUND OF THE INVENTION

Dampers and louvers are critical to the operational performance of HVAC systems in buildings and other structures. Such devices maintain building pressurization, prevent the spread of fire or smoke, and/or prevent water penetration during a tropical storm or hurricane.

Many critical devices, such as fire and smoke dampers, require periodic inspection and verification of operation on a specified schedule in order to comply with local, state, federal and/or international building and fire codes. Existing methods of inspection and verification typically require a technician to physically access the interior of the HVAC duct at the device location and to actuate the device in order to observe proper operation. As will be readily appreciated, however, this is often difficult because the device may be inaccessible or difficult to access, especially after building completion.

In view of the above, there is a need for a system and method that facilitates the noninvasive inspection of a damper or louver device within a HVAC system.

SUMMARY OF THE INVENTION

It is an object of the present invention to provide an inspection system for HVAC units.

It is another object of the present invention to provide an inspection system for HVAC units that provides for local and remote visual inspection and verification of damper operation.

These and other objects are achieved by the present invention.

According to one embodiment of the present invention, an inspection system for an HVAC device, such as a fire and/or smoke damper, is provided. The inspection system includes an HVAC duct section, a damper positioned with the duct section, an actuator for selectively moving the damper to a closed position, and a verification camera for recording the position of the damper with a date stamp and a time stamp. The actuator is further configured to move the damper to its open position, and the verification camera is further configured to record the open position of the damper with a second date and time stamp.

According to another embodiment of the present invention, an inspection method for an HVAC device, such as a fire and/or smoke damper, is provided. The method includes the steps of selectively controlling a damper to a first, closed position, and recording the damper position utilizing a camera with a first date and time stamp. The method also includes selectively controlling the damper to a second, open position, and recording the damper position utilizing the camera with second date and time stamp.

According to yet another embodiment of the present invention, an inspection system for an HVAC device is provided. The inspection system includes a duct section, a damper device positioned within the duct section, an actuator operatively connected to the damper device and being configured to selectively move the damper device between a closed position and an open position, and an image capture device configured to create a visual record of the damper device in the closed position and the open position and providing for remote visual inspection and verification of damper device operation.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENT

Figure 1:
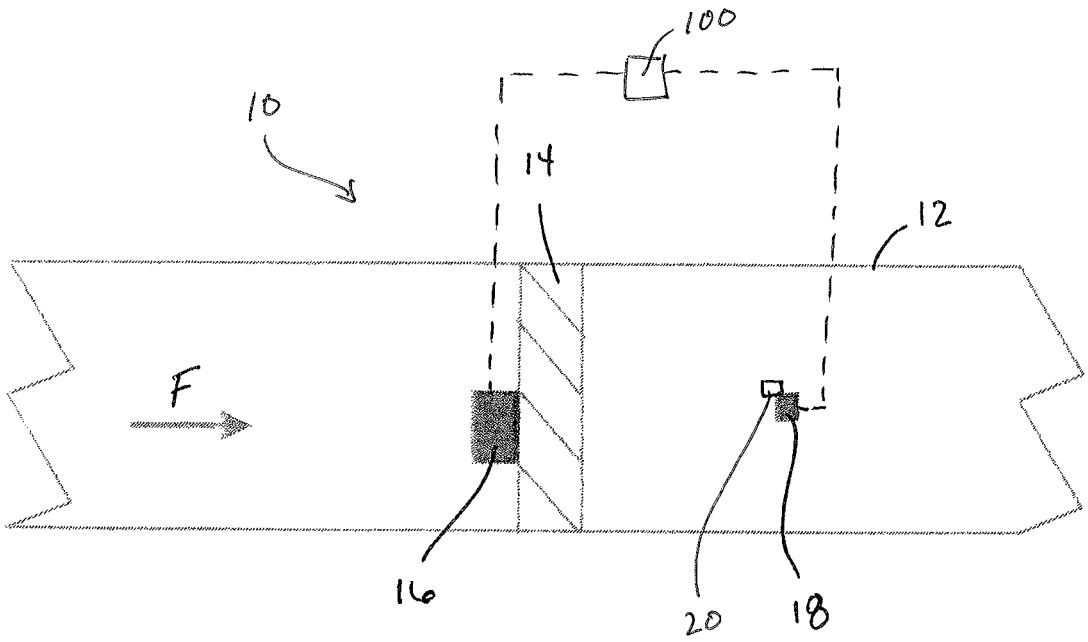
FIG. 1 is schematic illustration of an HVAC inspection system according to an embodiment of the present invention.
Figure 2:
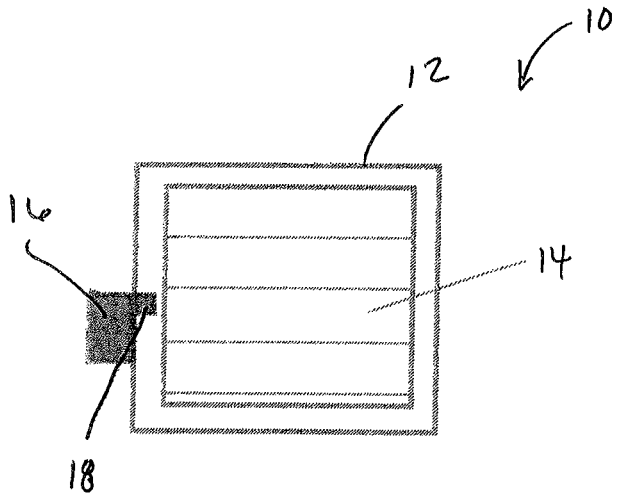
FIG. 2 is front, cross-sectional, schematic illustration of the HVAC inspection system of FIG. 1.

Referring to FIG. 1, the present invention relates to an inspection system for an HVAC device. As illustrated in FIG. 1, an HVAC system 10 typically includes an air transport duct 12 formed from a plurality of interconnected duct sections. The air transport duct 12 is configured to route conditioned air (e.g., heated, cooled and/or purified air) to desired locations within a building or other structure. The air transport duct 12 typically includes therein a series of damper or louver devices that are configured to control the air flow, F, within the duct. As is known in the art, the damper devices may be selectively controlled to a variety of positions within the duct in dependence upon a desired level of heating, cooling or the like. For example, known damper devices may be controlled between a fully closed position, in which the damper device substantially closes off the duct 12 to prevent air from flowing pass the damper device, to a fully open position corresponding to maximum air flow past the damper device.

In addition to standard damper and louver devices for controlling air flow within a duct, local, state, federal and/or international building and fire codes often require the presence of smoke or fire dampers. Fire, smoke and combination fire/smoke dampers are used to protect life and limit property loss during a life safety event. In particular, a fire/smoke damper is used with a building air handling system as a prevention device for the spread of fire and smoke. Fire/smoke dampers, unlike traditional HVAC dampers, typically function either in a fully open or fully closed position and, thus, extreme blade positions must be reachable and are regularly tested. FIG. 1 illustrates an exemplary fire or smoke damper 14 positioned within duct 12.

In connection with the above, HVAC system 10 may include an actuator 16 operatively connected to the damper 14. The actuator 16 is configured to actuate the damper in response to a control signal received from a control unit, for example, control unit 100. As illustrated in FIG. 1, the control unit 100 may be located remotely from the damper 14 and actuator 16, and may be coupled with the actuator 16 via a wireless or wired connection. In an embodiment, the control unit 100 may be a building management system or other centralized controller for controlling the HVAC system, as a whole, in response to a desired setpoint temperature or other input signals.

In addition, the system 10 includes a verification and monitoring device positioned within the duct 12 adjacent to the damper 14. For example, the verification monitoring device may be an image capture device such as a digital camera 18 having an associated light source 20 for recording or capturing a still image of a position of the damper 14, as discussed hereinafter. The image capture device 18 may likewise be in wired or wireless communication with the control unit 100 and receive operational commands therefrom.

In an embodiment, the actuator 16 is a hard-wired switching console that may be selectively actuated, in response to a signal received from the control unit 100, to open and close the damper 14. During a verification or testing mode, the control unit 100 may prompt the actuator 16 to move the damper 14 to its fully closed position. Once the damper 14 is closed, the control unit 100 controls the image capture device 18 to take a snapshot or still image (or otherwise record the position) of the damper 14 with a first date and time stamp that is then stored in a database associated with the control unit 100. After recording the 'closed' position of the damper 14 with a date and time stamp, the control unit 100 controls the actuator 16 to move the damper 14 to its normal or default operating state (i.e., the fully open position), and controls the image capture device 18 to record the 'open' position of the damper 14 with a second date and time stamp, that is likewise stored in a database.

In an embodiment, recording the position of the damper 14 may include taking a photograph or short video of the position of the damper 14. In an embodiment, the short video is of a duration long enough to capture movement of the damper 14 from the open position, to the closed position, and back to the open position. In yet other embodiments, the image capture device 18 is configured to transmit a live feed of the damper 18 back to the control unit 100 for display to an operator or technician, or for logging in memory or database. In certain embodiments, the image capture device 18 may operate on a time delay such that an image of the damper 14 is captured after a predetermined amount of time has elapsed after the command signal to open or close the damper 14 is communicated to the actuator 16.

In another embodiment, an actuator relay (not shown) may be incorporated into the image capture device 18. Once triggered, such as by the control unit, the relay would then actuate the damper 14 and the image capture device 18 would record the movement and/or position of the damper 14 in the manner described above.

In the preferred embodiment, the electronics for the image capture device 18 are mounted outside the duct section 12, with only a small penetration into the air stream for the camera lens and light source (such as a LED light source). In an embodiment, the image capture device 18 is located entirely outside the duct section 12 and has a line if sight to the damper 14 through a small aperture in a wall of the duct section 12. Importantly, this minimal intrusion into the duct section minimizes the disruption of air flow during system operation. Communications to and from the image capture device 18 and/or actuator 16 may be provided by various means known in the art, such as Power over Ethernet (PoE). In an embodiment, the software for addressing the image capture device 18 and/or actuator 16 and for recording verification results is capable of local or cloud based deployment and is capable of operating from a PC or as a device independent application for cloud based deployment.

Importantly, the system and method of the present invention allows for the noninvasive inspection of HVAC fire and smoke dampers. In particular, in contrast to existing methods, the system of the present invention allows for a visual record of inspection to be obtained without requiring a technician to physically enter the duct in the area of the damper. The inspection may be performed as needed, and as initiated by a technician or operator from a remote location, or may be carried out automatically at preset time intervals (e.g., weekly, monthly, yearly or the like).

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A HVAC system comprising:

an intact duct that is one of a plurality of interconnected duct sections;

a damper positioned within said duct and regulating a flow of air through said duct;

an actuator operatively connected to said damper to selectively move said damper between a closed position and an open position;

via a singular aperture in the duct, an image capture device directly observing and selectively recording a position of and a light source for illumination of said damper with a date and time stamp when capturing at least one image of said damper; and wherein said image capture device is configured to operate on a time delay.

2. The HVAC system of claim 1, wherein:

the image capture device is configured to capture a first image of the damper in the closed position with a first date and time stamp; and the image capture device is configured to capture a second image of the damper in the open position with a second date and time stamp.

3. The HVAC system of claim 2, further comprising:

a control unit configured to control the actuator to move the damper between the closed position and the open position, and to control the image capture device to capture the first image and the second image.

4. The HVAC system of claim 2, wherein:

the image capture device is located substantially outside the duct section.

5. The HVAC system of claim 1, wherein:

the image capture device is configured to record a short video of the damper, including movement of the damper from the open position to the closed position, and back to the open position.

6. The HVAC system of claim 1, wherein:

the image capture device selectively communicates a live feed of the damper for display.

7. The HVAC system of claim 2, wherein:

the damper is at least one of a smoke damper and a fire damper.

8. An apparatus for the inspection of an HVAC system comprising:

a plurality of interconnected ducts;

a damper disposed within a duct operationally regulating the flow of a gas within the plurality of ducts;

an image capture device and associated light source disposed on the exterior of the duct directly visualizing and illuminating said damper through a common aperture formed within a wall of the duct, said aperture minimally disrupting the flow of gas within the duct;

an actuator operatively connected to said damper and configured to selectively move said damper between closed and open states and any position betwixt;

a control unit in operative communication with said actuator and said image capture device; and wherein said control unit is in operative communication with said image capture device to record said position of said damper when said actuator moves said damper to one or more predetermined positions between said open position and said closed position;

wherein said control unit is in operative communication with said light source to operate with said light source in association with the image capture device; and, wherein said control unit controls said actuator to move said damper to one of said closed position and said open position, and controls said image capture device to take a first picture of said damper with a first date and time stamp.

* * * * *